United States Patent [19]

Bruns

[11] 4,429,491

[45] Feb. 7, 1984

[54] DOOR OPERATOR APPARATUS

[75] Inventor: James A. Bruns, Grand Rapids, Minn.

[73] Assignee: Abe W. Mathews Engineering Co., Hibbing, Minn.

[21] Appl. No.: 310,505

[22] Filed: Oct. 13, 1981

[51] Int. Cl.[3] ..... E05F 11/24

[52] U.S. Cl. ..... 49/340; 49/344

[58] Field of Search ..... 49/340, 344, 345

[56] References Cited

U.S. PATENT DOCUMENTS

| | | | |
|---|---|---|---|
| 1,269,545 | 6/1918 | Mengedoht . | |
| 1,716,707 | 6/1929 | Schoelkopf | 49/430 X |
| 1,859,364 | 5/1932 | Haskell . | |
| 2,550,349 | 4/1951 | Helz . | |
| 2,739,484 | 3/1956 | Orr . | |
| 3,103,351 | 9/1963 | Ahlgren . | |
| 3,269,061 | 8/1966 | Massina . | |
| 3,344,555 | 10/1967 | Hugle . | |
| 3,645,042 | 2/1972 | Bolli . | |
| 3,708,915 | 1/1973 | Davey . | |
| 3,864,875 | 2/1975 | Hewitt . | |
| 3,886,425 | 5/1975 | Weiss . | |
| 3,936,977 | 2/1976 | Runft et al. | 49/340 X |
| 4,007,557 | 2/1977 | Davis et al. . | |
| 4,079,988 | 3/1978 | Randall | 49/340 X |

FOREIGN PATENT DOCUMENTS

| | | | |
|---|---|---|---|
| 1351096 | 12/1963 | France | 49/340 |

*Primary Examiner*—Kenneth Downey

*Attorney, Agent, or Firm*—Merchant, Gould, Smith, Edell, Welter & Schmidt

[57] ABSTRACT

The present invention relates to a mechanism for operating a panel (12) suitably mounted to a frame (12). An actuator (13) pivotally attached to frame (11) provides a linear pulling and pushing force. A pivot arm (15) constructed and arranged for interconnecting actuator (13) to panel (12) and pivotally attached to panel (12) and actuator (13). A motion arm (14) pivotally attached to frame (11) and pivotal arm (15) cooperates with pivot arm (15) to transfer the linear force of actuator (13) into a panel (12) opening and closing force.

6 Claims, 9 Drawing Figures

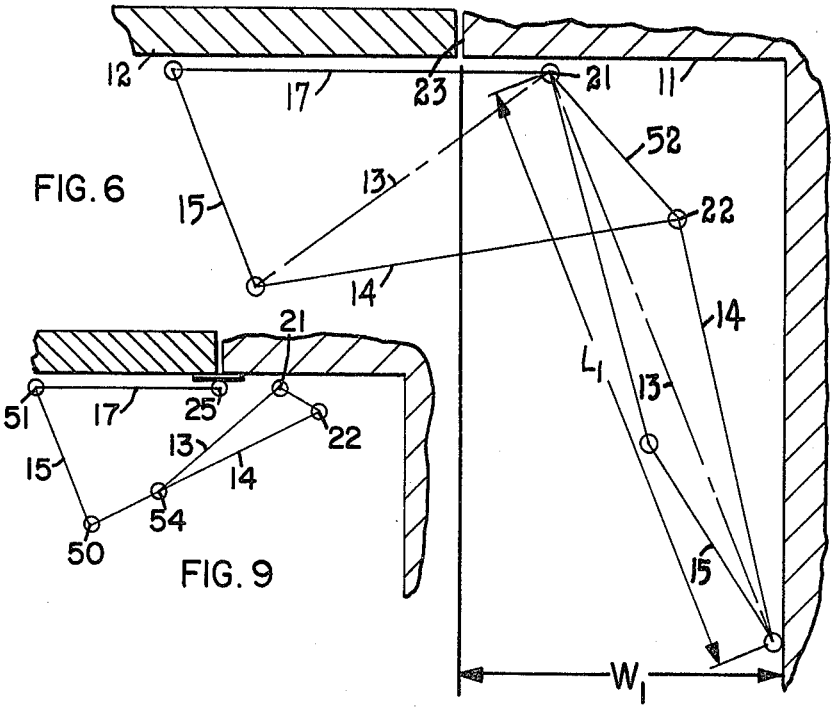
FIG. 6
FIG. 9
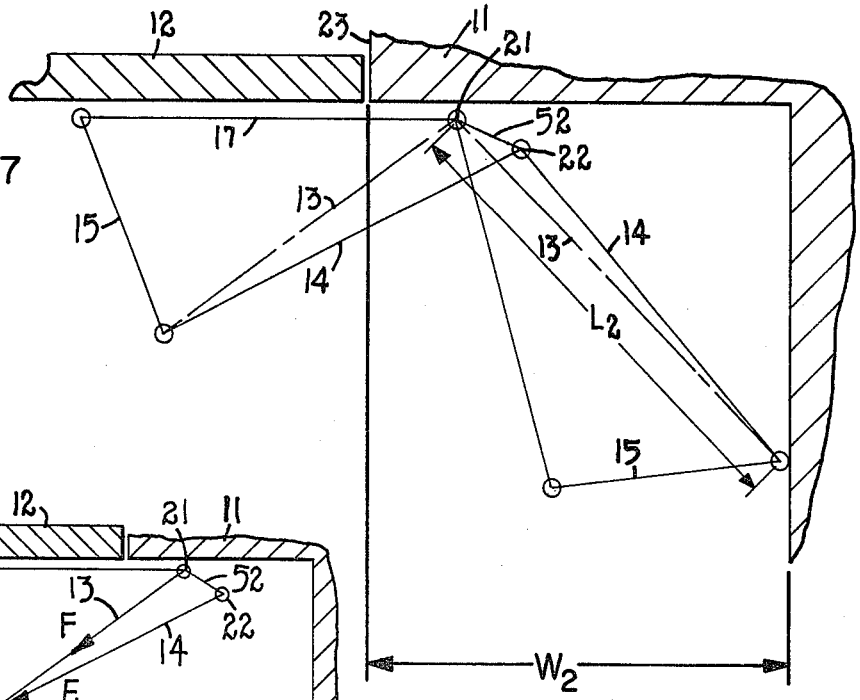
FIG. 7
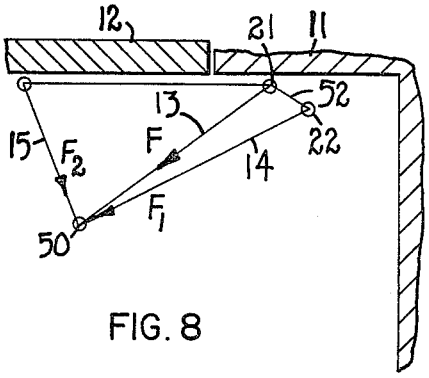
FIG. 8

DOOR OPERATOR APPARATUS

TECHNICAL FIELD

The present invention relates to a door operator apparatus. More particularly, the present invention relates to a door operator apparatus having a linear actuator providing a linear force in two directions, pushing and pulling and further including a linkage mechanism for transferring the linear force of the actuator into a door opening and closing force.

BACKGROUND OF THE INVENTION

Various door operating mechanisms have been designed to operate with various styles of doors. Frequently each type of operator is applied to a specific style of door. The most common types of doors which are mechanically operated can be separated into two general categories, i.e. sliding/rolling doors and hinged/pivoting doors. The pesent invention can be applied most readily to the hinged/pivoting type of door.

A hinged or pivoting type of door structure can be defined as a door structure which incorporates a large rigid panel suitably mounted or attached to a frame so as to pivot about an axis which is normally parallel to the longest edge of the panel. Frequently the door is supported by a plurality of hinges having one end fixedly secured to the edge of the door and the other end being fixedly secured to the door frame or doorjamb. The door then pivots about these hinges into open and closed positions. Frequently the pivotal motion of the door is about a vertical axis but this need not be the case and the door may be mounted for pivoting about a horizontal axis.

Another common type of hinged door is the folding door in which one or more panels are hinged together and attached to a panel which is hinged to the doorjamb. Both of these styles are very common in residential areas and are also very useful in industrial commercial applications.

Doors utilized in industrial and commercial applications may be very large in size, occasionally exceeding twenty feet in height and thirty in width. The present invention is especially constructed and arranged to easily open and close large commercial and industrial doors which satisfy the industrial and commercial standards therefor. However, the present invention can also be applied to residential use.

Currently there are many door operators designed for industrial and commercial use. One style of operator has a rotary actuator mounted onto the hinge. This style of operator is concealed above or below the door and is sometimes mounted along the height of the door where space permits. While this version of door operator is effective on relatively small doors, a drawback to this type of operator is that an extreme amount of torque is required to rotate the door if there is any load on the door due to large size, wind, etc. This in turn, requires relatively large hinges and hinge pins to evenly distribute loading, and also requires a very heavy-duty operator.

To overcome this problem, operators have been designed to fit in the space between the top of the door opening and the ceiling area. A typical design for this style of door operator might consist of two gear boxes driven by two separate motors or one motor on a common shaft. The output of each gear box is then conveyed to the door through a series of linkages or lever arms. The problem associated with this type of operator is that it requires considerable headroom which is sometimes not available. Another drawback is that the action of the mechanism is very hard to visualize and difficult to optimize prior to installation without individually laying out each size of door opening to verify that the mechanism will perform satisfactorily without hitting any part of itself or the door surroundings as it operates. A further drawback of this style of door operator is that it operates on the top edge of the door and can cause the door to twist as it opens and closes. This condition becomes worse as the loading and size of the door increase or if the door must be stopped midway in its operation.

Since some installations do not have sufficient headroom to permit the above described operator to be utilized, a similar style door operator is often mounted onto the top edge of the door instead of above the door. Such a door operator causes twisting of the door due to its location. It also requires additional side room when the door is open and places additional weight on the door subjecting the door and its supporting hinges to additional stress. Another drawback to top mounted door operatives is that maintenance is difficult to perform due to the high location.

Another approach has been to mount a door operator on the wall along the side of the door. This allows the opening and closing action of the operator to be transferred to the middle portion of the door which more effectively distributes loads thereby preventing twisting of the door. However, some doors can not be operated in this fashion due to insufficient side room to install the door operator.

Yet another approach has been to use an air cylinder to operate a spring arm mounted above the door. Such a door operator requires careful adjustment of geometry and action of the mechanism to provide satisfactory operation. The operation of the mechanism is also somewhat depenedent upon the loading on the door and has many of the problems attributed to the other styles of top mounted operators.

Some door operators have utilized an electrically operated hydraulic cylinder which is attached at one end thereof to a bracket in the middle of the door and attached at the other end thereof to a bracket located inside the doorjamb. The door operator mounted in this position projects out into the doorway when the door is open and is therefore frequently in the way of objects passing through the door opening.

The present invention overcomes many of these problems in the prior art by use of a linkage mechanism for converting linear force into a door opening and closing force.

SUMMARY OF THE INVENTION

The present invention relates to a mechanism for operating a panel suitably mounted to a frame. In one embodiment of the present invention, an actuator means attached to the frame provides a linear pulling and pushing force. A means constructed and arranged for linking the actuator means to the panel is attached to the panel and the actuator means. A means attached to the frame and one of the linking means and actuator means transfers the linear force of the actuator means into a panel opening and closing force.

In a second embodiment of the present invention an actuator and a motion arm are pivotally attached to a doorjamb. The motion arm is also pivotally attached at an opposite end thereof to a pivot arm. The pivot arm is in turn pivotally attached at an opposite end thereof to the door. The actuator is attached at its other end to one of the pivot arm and the motion arm. The actuator provides a linear pushing and pulling force. The door operator mechanism converts this linear force into a panel opening and closing force.

The present invention is particularly advantageous because it overcomes many of the problems encountered with the present style of operators used on panels hinged to a frame. The mechanism is particularly suited to overcome the problems associated with the operators for large industrial or commercial doors. The mechanism includes a small compact, easy to understand linkage which can be powered by various linear motion devices such as air cylinders, hydraulic cylinders, screw-type actuators, etc.

A mechanism can be attached anywhere along the hinged edge of the door. Preferably the mechanism is attached high enough above the floor surface so that it will not interfere with persons working in the area.

In normal situations, only one operator is used on each door panel. In situations where the door is very large or heavy loading is expected, additional operators may be attached to the door at various heights along the hinged edge. The present invention may also be used with folding panels. In such an application, an operator is placed on each of the panels mounted on the framework.

Another advantage of the present invention is its compact size thereby better avoiding interference with existing features of a building. The typical operator will extend out less than half the width of a panel to which it is attached. The usual space required for attachment to the frame of the door is less than one third of the width of one panel. In cases where the doorjamb does not extend past the hinge of the door, it is easy to extend the jamb in the area where the present invention is to be mounted. In most cases, the jamb mounting space is less than the space required to fully open the door so that the door clears the wall opening completely.

The present invention collapses behind the door panel as it opens so that minimal side room is required for the operator when the door is open. In normal applications, the operator will collapse to less than one sixth of the width of the door panel. This is less space than most current operators require when they are mounted in the jamb. Door mounted operators have been used in areas where there is insufficient side room, but they are usually mounted at the top of the door which causes twisting and poor closing action of the door.

The mechanism of the present invention allows simple and inexpensive operation of hinge-mounted doors in areas where present operators are being used, and also in areas where present operators will not perform satisfactorily due to geometry or space limitations.

In addition to its many other advantages, the present invention reduces the load or strain carried by the door during the door opening or closing process. Many of the current operators exert a force on the door in an unnatural direction. The doors must be specifically reinforced so that they will not buckle and the hinges will not be damaged. Also, the actuators which push the door closed must be very large in size to prevent buckling. In the present invention, most of the loading is carried by the operator. The force is nearly always transmitted to the door in an efficient manner by the linkage mechanism which converts the linear force of the actuator into a door opening and closing force. Because the present invention exerts less stress on doors, it can be added to most any existing doors without causing damage to the doors.

Since the linkage or operating mechanism of the present invention efficiently converts the linear push and pull force of an actuator into a door opening and closing force, a very slender actuator is used since bending movements are not involved and the span dimensions from fully expanded to fully retracted are relatively small in relation to the actuator. In addition, the actuator is in tension when the greatest forces must be exerted which allows use of a slender actuator without fear of buckling. As a result of the relatively minor demands on the actuator, many conventional types of actuators are available to operate in accordance with the present invention, e.g. hydraulic cylinders, linear electric actuators, double acting air cylinder, etc.

These and various other advantages and features of novelty which characterize the invention are pointed out with particularity in the claims annexed hereto and forming a part hereof. However, for a better understanding of the invention, its advantages, and objects obtained from its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

FIG. 6 is a diagrammatic view of the present invention in opened and closed positions, the present invention having the general configuration of a parallelogram;

FIG. 7 is a diagrammatic view of the present invention in opened and closed positions, the present invention having the general configuration of a quadrilateral which is not a parallelogram;

FIG. 8 is a diagrammatic representation of forces exerted by the actuator; and FIG. 9 is a diagrammatic representation showing the actuator attached to the motion arm.

DETAILED DESCRIPTION OF THE INVENTION

Figures 1, 3, 4:
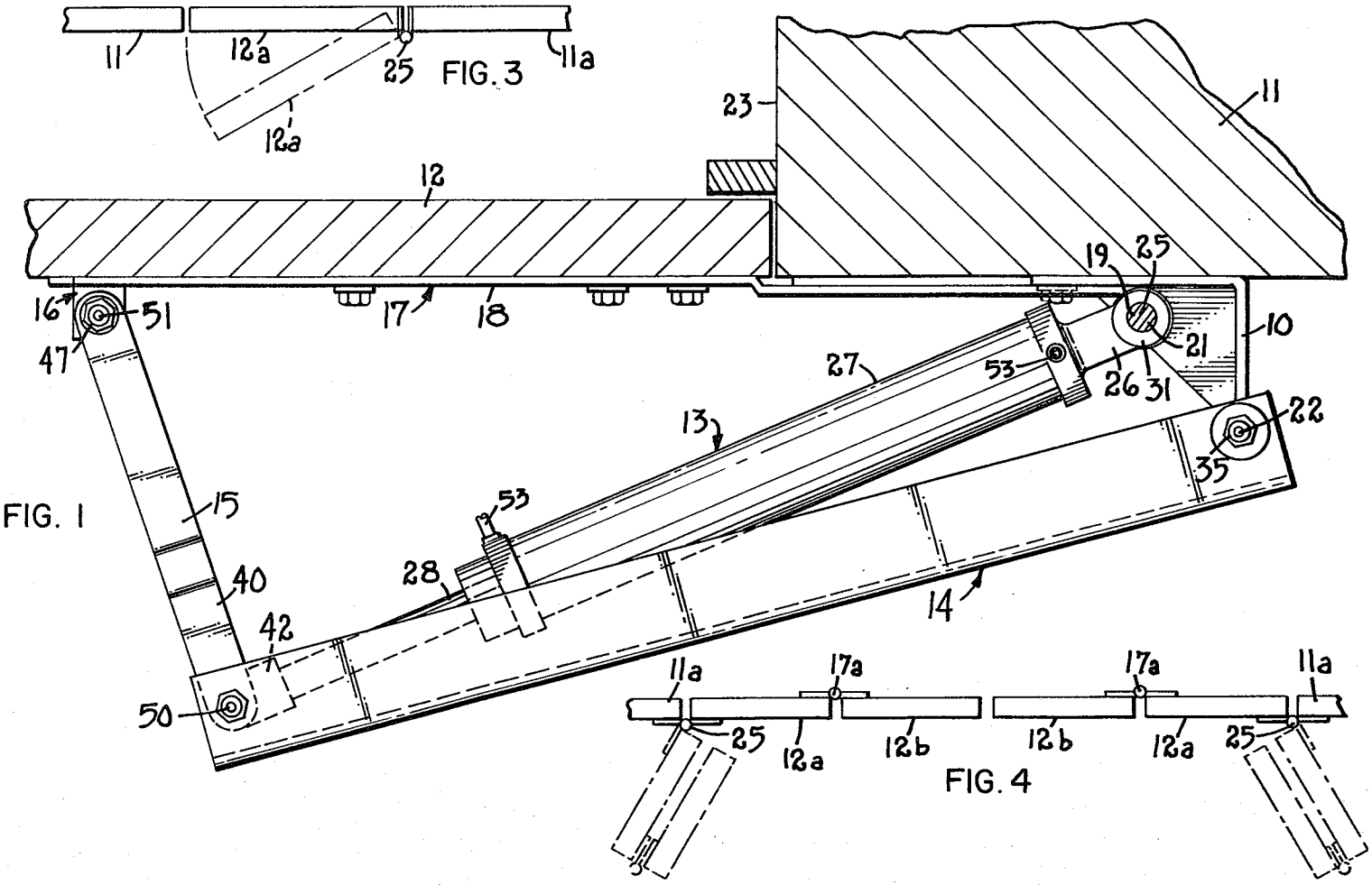
FIG. 1 is a top plan view of the present invention.
FIG. 3 is a diagrammatic view of a panel having a pivotal axis about the edge of a doorjamb.
FIG. 4 is a diagrammatic view of a four-fold panel.

Referring now the drawings, there is shown in FIG. 1 a preferred embodiment of the present invention. The embodiment shown includes a bracket 10 mounted to a doorjamb or door frame 11 on which a panel or door 12 is pivotally hinged by hinges 17, only one of which is shown. Pivotally attached to bracket 10 are an actuator 13 and a motion arm 14. Actuator 13 and motion arm 14 are also pivotally attached at an opposite end thereof to an end of a pivot arm 15. Pivot arm 15 is in turn pivotally attached at an opposite end thereof to a bracket 16 mounted on door 12. Actuator 13 and arms 14 and 15 may be pivotally interconnected using any suitable pivotal connections such as pin or bearing structures.

Figure 2:
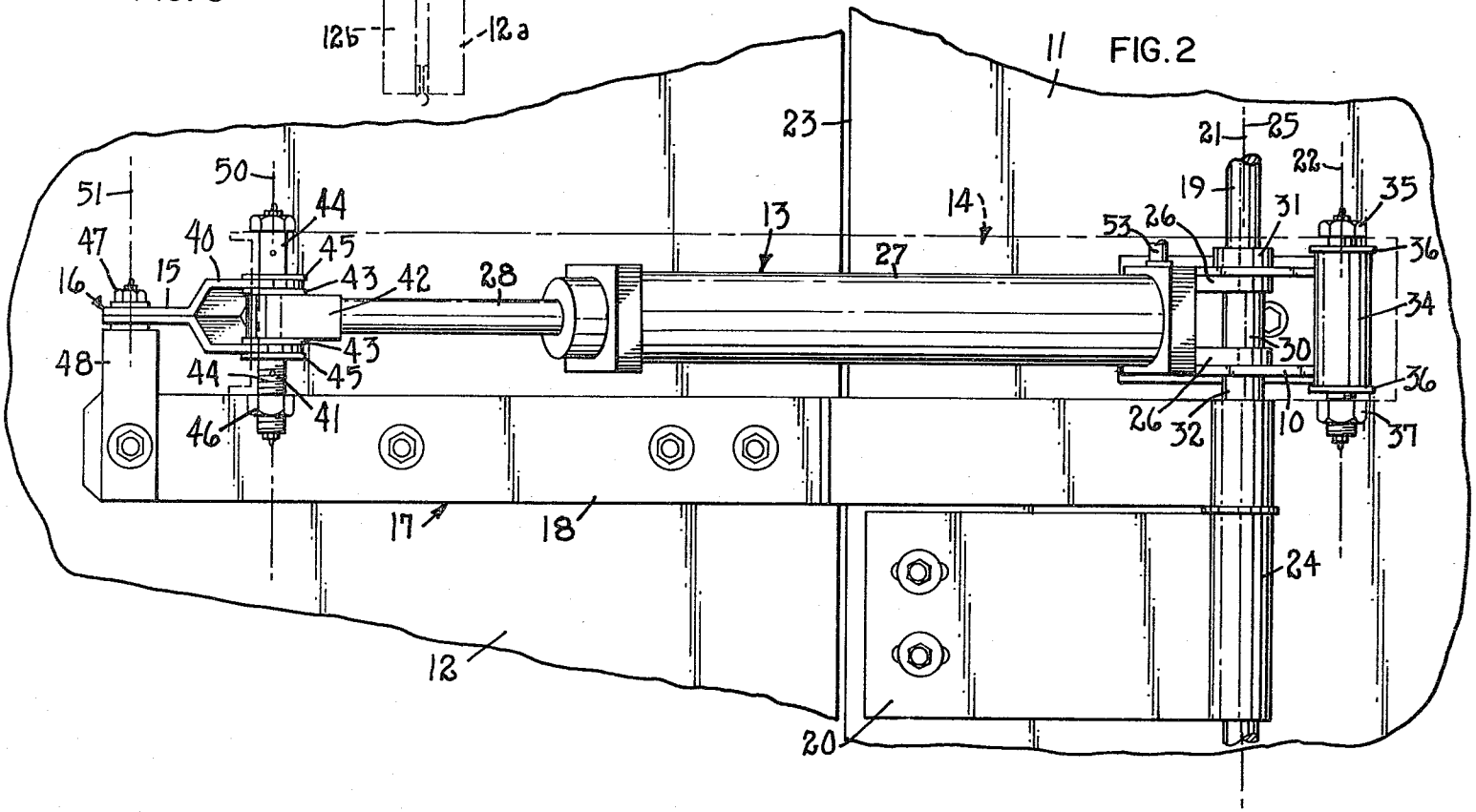
FIG. 2 is a side elevational view of the present invention.

More particularly, as illustrated in FIGS. 1 and 2, bracket 10 is shown as being fixedly secured to doorjamb 11 a distance offset from an edge 23 of doorjamb 11. Bracket 10 is offset from edge 23 so that clearance is maintained for door 12 as it opens. Bracket 10 typically provides two stationary pivotal mounting points for actuator 13 and motion arm 14 such that actuator 13 pivots about an axis 21 and motion arm 14 pivots about an axis 22. However, the pivotal mounting points may be located on individual mounting brackets. Axis 22 is further removed from doorjamb 11 and door 12 than axis 21. It is preferred that bracket 10 be mounted at the same approximate height as one of the hinges 17 of door 12, preferably in the middle of door 12 at a height sufficient so as to not create any interference with activity adjacent or through the door opening.

As shown in FIG. 2, door 12 is attached at an edge thereof to a strap 18 of hinge 17. Strap 18 pivots about a pintle 19 which is housed in a tubular column portion 24 of hinge 17. Hinge 17 is fixedly secured to doorjamb 11 by cooperating strap 20. A washer separates straps 18 and 20 at the tubular column portions 24 thereof. Note that in FIG. 2, pintle 19 is shown as being offset from edge 23 of doorjamb 11. Thus, door 12 as shown in FIG. 2 pivots about a stationary axis 25, which is the same as axis 21. The present invention will also function with doors where pivotal axis 25 is at the edge of doorjamb 11 as illustrated in FIG. 3 or is not the same as axis 21. It should be noted that axis 25 may have a vertical orientation or a horizontal orientation. The present invention will function on a door 12 having pivotal axis 25 of any orientation if axis 25 is substantially parallel to the plane of door 12.

It is desirable to pivot actuator 13 and pintle 19 such that axes 25 and 21 are the same. However, if this is not possible, axis 21 about which actuator 13 pivots may be located at another position adjacent doorjamb 11. Actuator 13, however, should be located at approximately the same height as motion arm 14 and pivot arm 15. Axis 21 should also be substantially parallel to the plane of door 12 and substantially parallel to axis 25. The preferred location for axis 21 of actuator 13 is as close as possible to axis 25 while allowing clearance for actuator 13 so that it can pivot without interference generally between an angle of approximately zero degrees, the closed door position, to a maximum of approximately 115 degrees, the open door position. Those angles provide for efficient operation of actuator 13 without severely confining the dimensions of actuator 13. In certain instances, actuator 13 may not be pivotally attached to bracket 10. Actuator 13 may be pivotally attached at some other location adjacent doorjamb 11. Actuator 13 when attached to doorjamb 11 will still form an acute angle with the plane of door 12.

Actuator 13 of the present invention may be any suitable linear actuator such as a hydraulic cylinder/piston arrangement, a double acting air cylinder, a linear electric actuator, a compression spring mounted around a telescoping tube, etc., which provides a linear force in two directions. In FIG. 2, actuator 13 is a suitable hydraulic cylinder having a cylinder 27 and a piston rod 28 which is retractably extensible from an end of cylinder 27. Attached to the opposite end of cylinder 27 are two extending cylinder support members 26 adapted for reception of pintle 19. Note that if actuator 13 is not pivoted at pintle 19, then extending members 26 may be constructed and arranged for reception of a pin-like member or for any other suitable pivotal mounting mechanism.

In the preferred embodiment shown, a pintle bushing 30 is positioned between extending members 26. Extending members 26 are in turn aligned with apertures in bracket 10 such that pintle 19 can be inserted through bracket 10 and extending members 26. A locking collar 31 is positioned around pintle 19 over bracket 10 to retain bracket 10 and extending members 26 in place. A bushing 32 is positioned between mounting bracket 10 and tubular column 24 adapted for reception of pintle 19.

Motion arm 14 may be any suitable rigid elongated member. In FIG. 1, motion arm 14 is illustrated as being a channel having substantially three sides. (Motion arm 14 is shown in broken lines in FIG. 2). The horizontal sides of the channel each have apertures at both ends thereof. The apertures at a particular end are in alignment with each other and are adapted for reception of a pin or bolt-like member. In the preferred embodiment, mounting bracket 10 has a tubular member 34 extending between the sides of arm 14. Apertures in motion arm 14 are aligned with tubular member 34 and a pivot bolt 35 is inserted therethrough. Washers 36 are positioned between motion arm 14 and the ends of tubular member 34. A self-locking nut 37 is then positioned on pivot bolt 35. Motion arm 14 is designed to swing between an angle approximately zero degrees representing the door closed position to an angle approximately 115 degrees representing the door open position.

Tubular member 34 is substantially parallel to the plane of door 12 such that stationary axis 22 about which motion arm 14 pivots is substantially parallel to door 12. Note that axis 22 for motion arm 14 is somewhat removed from the plane of door 12 whereas the axis 21 for actuator 13 is more nearly adjacent the plane of door 12. Axis 22 is also substantially parallel to axes 25 and 21.

Actuator 13 is pivotally attached to one of motion arm 14 and pivot arm 15. Motion arm 14 in turn is attached to pivot arm 15. Normally and in the embodiment shown in FIGS. 1 and 2, actuator 13, motion arm 14, and pivot arm 15 are pivotally interconnected so as to pivot about an axis 50. However, this need not be the case, as actuator 13 may be attached to one of motion arm 14 and pivot arm 15 at some other location so as to pivot about a different axis 54, one embodiment of which is geometrically illustrated in FIG. 9.

Pivot arm 15, as shown in FIG. 2, may include a rigid elongated member having a clevis 40 at an end removed from door 12. Clevis 40 is adapted for reception of a pivot bolt 41 similar to that of pivot bolt 35 utilized to pivotally attach motion arm 14 to bracket 10. Piston rod 28 has an attachment 42 at the end thereof. Attachment 42 has an aperture therein adapted for reception of pivot bolt 41. In the embodiment shown in FIGS. 1 and 2, attachment 42 is positioned between the ends of clevis 40 such that the apertures in attachment 42 and clevis 40 are in alignment. However, attachment 42 may be attached elsewhere along one of motion arm 14 and pivot arm 15. Attachment 42 may be separated from the clevis 40 by suitable washers 43. The apertures in the end of motion arm 14 are also aligned with the apertures in clevis 40 and attachment 42 such that pivot bolt 41 can be inserted therethrough. Spacers 44 separate the sides of motion arm 14 from clevis 40 while washers 45 are suitably located between spacers 44 and clevis 40. A self-locking nut 46 is utilized to pivotally retain motion arm 14, actuator 13, and pivot arm 15 in place. Suitable spacers may be utilized for support between washers 45 and the sides of motion arm 14. Thus pivot arm 15, motion arm 14, and actuator 13 pivot in a plane substantially normal to that of door 12.

Pivot arm 15 is also pivotally attached to door 12 at bracket 16 so as to pivot about an axis 51. Pivot arm 15 has an aperture at the end thereof adapted for reception of a pivot bolt 47 or the like. Bracket 16 has a hollow tubular hinge pivot or similar pivotal device 48 which is attached to strap 18 of hinge 17 and which is adapted for reception of pivot bolt 47. While it is desirable to attach bracket 16 to strap 18, bracket 16 may be attached in any suitable manner to the surface of door 12.

It should be noted that while the pivotal mechanisms have been described in detail above, any suitable pivotal structure will suffice.

Bracket 16 is attached to door 12 so as to allow clearance of pivot arm 15 which is pivotally attached to bracket 16. However, bracket 16 should be as close as possible to the surface of door 12 and still maintain sufficient clearance for pivot arm 15.

Figure 5:
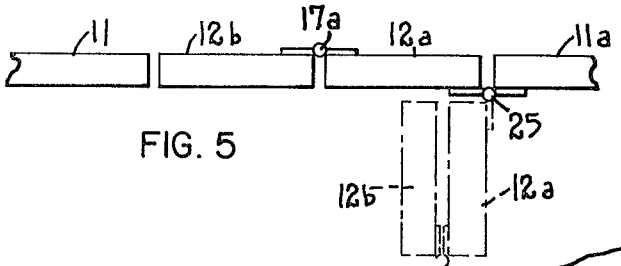
FIG. 5 is a diagrammatic view of a bi-fold panel.

Note that the above-described patent invention can be utilized on single-panelled doors as shown in FIG. 3, or on multi-panelled doors such as the two-fold panelled doors shown in FIG. 5 and the four-fold panelled doors illustrated in FIG. 4. In the multi-door configuration as shown in FIGS. 4 and 5, the door operator mechanism is suitably attached to doorjamb 11*a* and panel 12*a* as herebefore described such that panels 12*a,b,* being pivotally interconnected by hinges 17*a,* fold upon each other and pivot about axis 25 upon activation of said door operator mechanism. The mounting of each door operator for a multi-fold door is symmetric about the center-line of the door opening.

As shown geometrically in FIGS. 6 and 7, when door 12 is closed, the door operator mechanism has the general configuration of a quadrilateral whose sides include motion arm 14, pivot arm 15, hinge 17, and a line 52 joining axes 21 and 22. In FIG. 6, the door operator mechanism is shown as having the general configuration of a parallelogram. Motion arm 14 is approximately parallel to hinge 17 and pivot arm 15 is approximately parallel to line 52. The door operator mechanism in FIG. 7 does not have the general configuration of a parallelogram.

The closer the door operator mechanism is to forming a parallelogram, the less space the door operator mechanism requires as it folds behind door 12 as door 12 is opened. FIGS. 6 and 7 have been drawn so that edge 23 of doorjamb 11 is in general alignment. As illustrated in FIGS. 6 and 7, the doorjamb width or space $W_1$ required by the door operator mechanism of FIG. 6 when the door is opened is less than the doorjamb width or space $W_2$ required by the door operator mechanism of FIG. 7 which does not have the general configuration of a parallelogram.

Note, however, that the length $L_1$ of actuator 13 in FIG. 6 when door 12 is open is greater than the length at $L_2$ of actuator 13 in FIG. 7 when door 12 is open. Since actuator 13 and motion arm 14 pivot about axes 21 and 22 relatively close to each other in FIG. 7, the extension required of actuator 13 is less than the extension required in FIG. 6 where axes 21 and 22 are further apart. Thus, the door operator mechanism of the present invention having the configuration as shown in FIG. 6 will require that actuator 13 have a longer stroke than actuator 13 of the embodiment geometrically illustrated in FIG. 7. This normally requires a more heavy-duty and rugged actuator 13 since the longer stroke requirement will subject actuator 13 to more stress. The configuration shown in FIG. 7 therefore allows a lighter or more slender actuator to be utilized although requiring more doorjamb 11 space.

The exact configuration of the present invention thus will vary from installation to installation depending on the various requirements. This is due to the trade-off between the space requirement of doorjamb 11 and the length or size of actuator 13. In some situations, the door operator mechanism will have the general shape of a parallelogram in order to require less doorjamb space. The door operator mechanism may differ from a true parallelogram only to allow for physical size of actuator 13 and the constraints of the various mounting brackets. In other applications, where doorjamb space is not a problem or extremely heavy doors or loads will be encountered, the door operator mechanism may not have the configuration of a parallelogram in order to gain mechanical advantage and utilize a lighter actuator due to the shorter stroking distance involved.

The length of pivot arm 15 is kept relatively short to make the door operator mechanism compact and prevent pivot arm 15 from protruding a great distance from door 12 when door 12 is closed. Per the above discussion, the mechanical advantage of the door operator mechanism is increased by increasing the length of pivot arm 15 if all other arms remain essentially constant.

It is not necessary to change the door operator mechanism dimensions for small changes in panel 12 width. Generally, the same size door operator mechanism can be efficiently used on panels 12 varying somewhat. This allows one size of door operator mechanism to handle many sizes of panels 12 without having to vary any of the mounting dimensions.

In operation, the elements of the door operating mechanism are operatively interconnected with actuator 13 to serve as a force transfer linkage for translating the linear force of actuator 13 into a door opening and closing force. The linkage mechanism cooperates with actuator 13 to convert the linear motion of actuator 13 into a rotational motion. When piston 28 of actuator 13 is extended or retracted, a linear force is applied to motion arm 14. The motion arm 14 reacts by attempting to move in the direction of the force applied. However, since motion arm 14 is pivotally attached to door frame 11, which is stationary, motion arm 14 can not move in the direction of the force. If motion arm 14 and actuator 13 were pivotally attached to door frame 11 so as to be pivoted about the same stationary axes 21 and 22, the door operator mechanism would not move since motion arm 14 would prevent any extension or retraction of piston 28 from actuator 13.

In the present invention, since motion arm 14 and actuator 13 are pivotally attached to different stationary points on door frame 11, the linear force F applied by actuator 13 on motion arm 14 may be broken down into two components of force. As shown in FIG. 8, one of the components $F_1$ is parallel to motion arm 14 and the other component $F_2$ is parallel to pivot arm 15. The component of force $F_1$ parallel to motion arm 14 is small and has no effect since motion arm 14 is attached to bracket 10, which is stationary and does not allow linear movement. However, the component of force $F_2$ parallel to pivot arm 15 is nearly equivalent to F and will pivot motion arm 14 about axis 22 and hence will open door 12 since motion arm 14 is connected to door 12 by pivot arm 15.

As motion arm 14 changes position, force $F_2$ is exerted on pivot arm 15. Since pivot arm 15 is pivotally attached to door 12, pivot arm 15 will transfer the force to door 12. As the direction of the force applied changes due to the rotation of motion arm 14, pivot arm 15 will pivot so the force is applied to door 12 in an efficient manner. Thus door 12 is open or closed as piston 28 of actuator 13 is extended or retracted.

As door 12 is pivoted, motion arm 14 and actuator 13 pivot substantially simultaneously in the same direction and at approximately the same rate as door 12 between the extreme operating positions representing the open and close positions of door 12. Pivot arm 15 in turn pivots about axes 50 and 51 so as to effectively transfer the force to door 12.

The present invention allows a relatively slender actuator to be used since bending moments are not involved and the span dimensions from fully extended to fully retracted are relatively less than that which would be required of an actuator not utilized with the operating mechanism of the present invention.

In addition, actuator 13 of the present invention is extended to open door 12 and retracted to close door 12. An actuator utilized by itself and attached to doorjamb 11 would be extended to close door 12 and retracted to open door 12. Such an actuator would not be in tension when the greatest forces were exerted and would be susceptible to heavy stress loads.

An actuator utilized by itself also has the possibility of placing a tremendous amount of force on the door panel in an unnatural direction. A door panel thus frequently requires reinforcing so that it will not buckle or the hinges be damaged. In the present invention, the forces of the actuator are efficiently transferred to the door by the linkage mechanism, thereby reducing the stress on the door.

Many types of actuators 13 can be used to operate the door operating mechanism of the present invention. Double-acting air actuators, hydraulic cylinders, linear electric actuators, eetc. can be utilized. Actuator 13 may also be a compression spring wrapped around a telescoping tube. The spring would push door 12 open. A cable would run down the center of the tube or would be fastened at the pin connection of motion arm 14 and pivot arm 15. Door 12 could then be closed by pulling the cable.

Whatever type of actuator is chosen, it is preferably controlled so that door 12 will not slam open or shut and yet operate at a speed sufficient to move door 12 in a specified period of time.

Actuator 13 requires a suitable control mechanism for activation and operation of said door operator mechanism during the door opening and closing process. In one embodiment, where a hydraulic cylinder is used as actuator 13, a hydraulic pump may be used to provide the hydraulic pressure via hydraulic hoses 53 suitably attached to cylinder 27 as illustrated in FIG. 1. A hydraulic circuit may be designed which will allow the flow of hydraulic fluid to be reversed by electrically changing the direction of rotation of the hydraulic pump motor. Overall flow to and from cylinder 27 may be adjusted using a common flow control valve mechanism which also incorporate a check valve mechanism so that efficient flow or motion can be adjusted in each direction.

The present invention as described above is relatively easy to control and adaptable to many different control mechanisms.

It is to be understood, however, that even though these numerous characteristics and advantages of the invention have been set forth in the foregoing description, together with details of the structure and function of the invention, the disclosure is illustrative only, and changes may be made in detail, especially in matters of shape, size and arrangement of parts within the principle of the invention, to the full extent indicated by the broad general meaning of the terms in which the appended claims are expressed.

What is claimed is:

1. A mechanism for operating a panel rotatably mounted to a frame, comprising:

(a) actuator means, attached at one end to the frame, for providing a linear pulling and pushing force;

(b) means for linking said actuator means to the panel; and (c) means for transferring the linear force of said actuator means into an opening and closing force for said panel, said transferring means including a first elongated member pivotally attached at one end thereof to said frame, said linking means including a second elongated member pivotally connected at one end thereof to the panel, said actuator means being pivotally attached at a second end to second ends of said first and second elongated members so as to form a common pivot point.

2. A mechanism for operating a door suitably attached at an edge thereof to a doorjamb for pivotal movement about a first axis between open and closed positions, said door having front and back surfaces, said mechanism comprising:

(a) actuator means for providing a linear pulling and pushing force, said actuator means having first and second ends, said actuator means being pivotally attached at said first end to the doorjamb; and (b) linkage means operatively interconnected with said actuator means for transferring said linear force of said actuator means into a door opening and closing force to pivot the door about said first axis, said linkage means including a first elongated member having first and second ends and a second elongated member having first and second ends, said first elongated member being pivotally attached at said first end to the doorjamb, said second elongated member being pivotally attached at said first end to the door said first and second elongated members being pivotally interconnected to form a common pivot point, said actuator means being pivotally attached at a second end to one of said first and second elongated members, said actuator means, said first elongated member, and said second elongated member operating in a second plane normal to said back surface of said door.

3. Apparatus for rotatably moving a door suitably attached to a jamb about a first axis between open and closed positions, comprising:

(a) means for moving said door by providing a linear force; and (b) linkage means for converting the linear force into a door opening and closing force, said linkage means including first and second rigid elongated members being pivotally attached at a second axis, said first elongated member at an opposite end from said second axis being pivotally attached to said door, said second elongated member at an opposite end from said second axis being pivotally attached to said jamb so as to be pivotable about a third axis;

said door, said first and second elongated members, and a line joining said first axis and said third axis forming a quadrilateral shape, said linear force being applied to said second axis;

whereby said quadrilateral shape provides mechanical advantage for said moving means while opening and closing said door.

4. Apparatus in accordance with claim 3 wherein said quadrilateral is substantially a parallelogram such that said door and said first and second members fold together relatively closely during door opening, thereby saving space although decreasing the mechanical advantage of said moving means.

5. Apparatus for rotatably moving a panel mounted to a frame, comprising:

(a) hinge means for pivotally connecting said panel to said frame;

(b) linkage means for connecting said panel and said frame, said linkage means including first and second linkage members, said first and second members being pivotally attached together at an axis; and (c) means for moving said axis, said moving means including a force applying element, said moving means causing said element and said axis to move at the same speed;

whereby operation of said moving means requires said linkage means to force movement of said panel relative to said frame.

6. A mechanism for operating a panel suitably hinged at an edge thereof to a frame so as to allow limited pivotal movement about a first axis between an opened and a closed position, comprising:

(a) a first bracket fixedly mounted upon the frame adjacent the hinged edge of the door;

(b) an actuator having first and second ends for providing a linear pushing and pulling force, said actuator being pivotally attached at said first end to said first bracket such that said actuator is pivotal about a stationary second axis substantially parallel to said first axis;

(c) a pivot arm for interconnecting said actuator to the door, said pivot arm having first and second ends;

(d) a second bracket suitably mounted adjacent a side of the door, said bracket providing means for pivotally attaching said first end of said pivot arm to the door; and (e) a motion arm having first and second ends, said motion arm being pivotally attached at said first end thereof to said first bracket so as to be pivotal about a stationary third axis substantially parallel to and spaced from said second axis, said motion arm being pivotally attached at the second end to the second end of said pivot arm and said actuator being pivotally attached at the second end to the second end of said pivot arm said actuator pivoting the second ends of said actuator, said pivot arm, and said motion arm at a common pivot point about a fourth axis parallel to said first axis;

whereby said mechanism operates as a transmission linkage to transfer the linear force of said actuator into a door opening and closing force to pivot the door about said first axis.

* * * * *